United States Patent [19]

Aaras et al.

[11] 4,277,102

[45] Jul. 7, 1981

[54] CHAIR

[75] Inventors: Arne Aaras, Lorenskog; Kjell M. Martinsen, Oslo; Rikard Nakland, Hovik, all of Norway

[73] Assignee: International Standard Electric Corporation, New York, N.Y.

[21] Appl. No.: 39,758

[22] Filed: May 17, 1979

[30] Foreign Application Priority Data

May 24, 1978 [NO] Norway ..... 781801

[51] Int. Cl.[3] ..... A47C 7/54

[52] U.S. Cl. ..... 297/411; 248/118; 297/115; 297/417; 403/115

[58] Field of Search ..... 297/115–117, 297/161, 173, 405, 411, 422, 417, DIG. 4; 403/57, 68, 76, 80, 90, 115, 122, 124–126; 248/118; 5/503, 505, 508, 507

[56] References Cited

U.S. PATENT DOCUMENTS

| | | | |
|---|---|---|---|
| 461,928 | 10/1891 | White | 297/115 |
| 762,877 | 6/1904 | Browne | 297/411 |
| 805,074 | 11/1905 | Kemp | 297/173 X |
| 866,753 | 9/1907 | Weber | 297/405 |
| 1,279,120 | 9/1918 | Kellogg | 297/417 X |
| 1,516,795 | 11/1924 | Schwarting | 248/118 X |
| 1,706,634 | 3/1929 | Seils | 248/118 X |
| 3,072,426 | 1/1963 | Gilbert | 403/115 |
| 3,191,994 | 6/1965 | Boyce | 297/466 X |

FOREIGN PATENT DOCUMENTS

| | | | |
|---|---|---|---|
| 528877 | 6/1955 | Italy | 403/90 |
| 467047 | 2/1969 | Switzerland | 297/DIG. 4 |

*Primary Examiner*—James T. McCall

*Attorney, Agent, or Firm*—James B. Raden; Marvin M. Chaban

[57] ABSTRACT

A chair mechanism having a seat portion, a back rest and arm rests. The arm rests are individually supported on arms mounted on the seat support member. The seat back is mounted to a telescoping seat bearing column with the seat enabling joint movement. The back rest is also movable independently relative to the seat. The connection of the arm rests to the support arms and the support arms to the seat body is through the use of universal joints allowing movement in all directions. The seat bearing column rests on a circular base plate with roller sets about its periphery. With the multiple, wide angle range of adjustments which may be easily performed, the chair mechanism provides comfortable, multi-use support for its occupant.

8 Claims, 5 Drawing Figures

CHAIR

Figure 1:
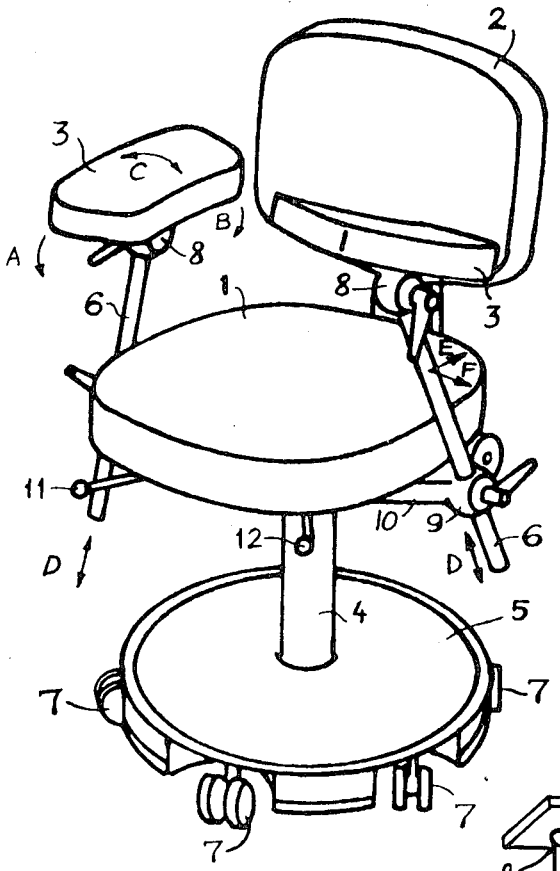

This invention relates to a chair, and in particular to a chair having adjustable arm rests being fastened to the chair via supporting members being adjustably connected to the body of said chair.

Such chairs are earlier known in many different embodiments. In one known embodiment the supporting member was a rod passing through a vertical tube, and being adjustably fastened within said tube by means of at least one locking screw, or by means of pins inserted in horizontally arranged holes penetrating both the tube and the rod. By such an arrangement the arm rests may be raised or lowered.

Recently there has also been seen a chair on which the arm rests may be moved outwards/inwards as the vertical tubes may be moved slightly.

With these known arrangements there are obtained chairs which may be adjusted, as far as the position of the arm rests is concerned, to small and large individuals. In all chairs known so far, the arm rests may be adjusted only in these two directions, and to allow such adjustments at least one lever has to be operated to lock/unlock the arm rest in each movable direction.

It has recently been found that the sick-leave of employees doing routine jobs very often is due to rather small, but long lasting physical stress.

The main object of said invention therefore is to provide a chair which is easy to adjust so that it supports the different parts of the body in any desired position, without representing an additional stress or local compression of soft body tissue.

Another object of this invention has been to develop a universal joint which in released state allows movements in any directions between predetermined limits, and which may be locked in all and every direction by operating of one lever only.

Still a further object of the present invention has been to develop a universal joint which allows small movements in all directions about a locked position, due to externally attacking forces.

A further object of the present invention has been to develop a universal joint where movements in different directions may be locked in a predetermined sequence as the lever is tightened.

A further object has been to provide a chair having a tiltable seat portion and an adjustable back rest, and where tilting of the seat does not result in a corresponding tilting of the back rest, but only in an up/down movement of said back rest, so that it always supports the same region of the back of the user, notwithstanding the actual seat tilt.

All these objects may be fullfilled by a chair according to the claims below.

Factory tests have proved that a chair according to the present invention reduces the stresses on the user, and also reduces the sickleave percentage considerably.

Some preferred embodiments of the chair according to this invention also reduce the compressions of certain veins of the human body, and thus a reduction of such diseases as phlebitis and varicose vein is anticipated when this chair is used.

A specific advantage of said chair is that adjustments of its moveable elements are so easy to undertake that the user virtually makes the desired adjustments each time when it is desirable. In some embodiments the smaller adjustments are also automatically undertaken, as small movements may be allowed around the locked position as soon as the load from the body changes.

Figure 2:
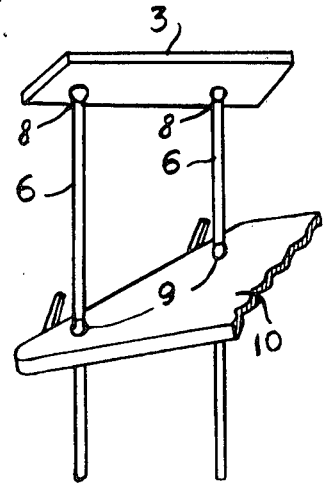
Figure 3:
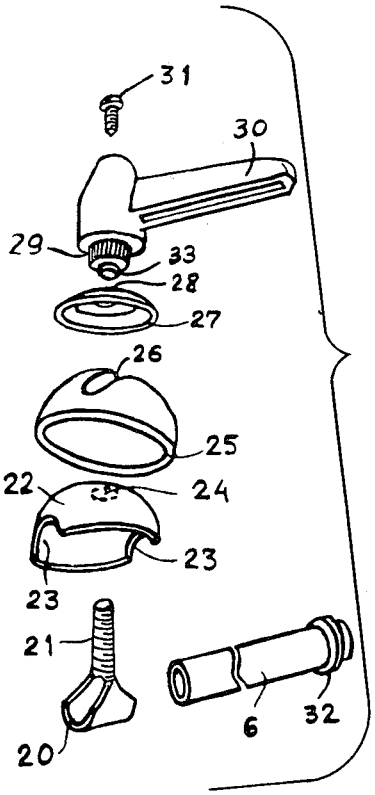
Figure 4:
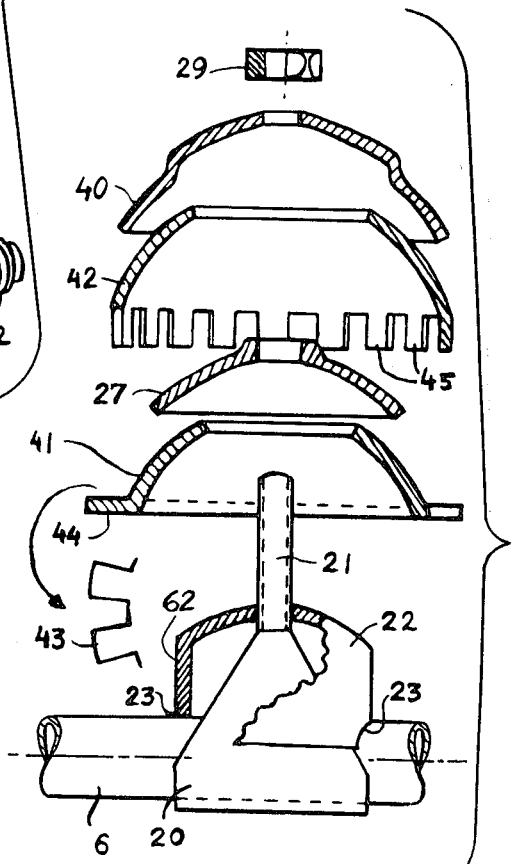
Figure 5:
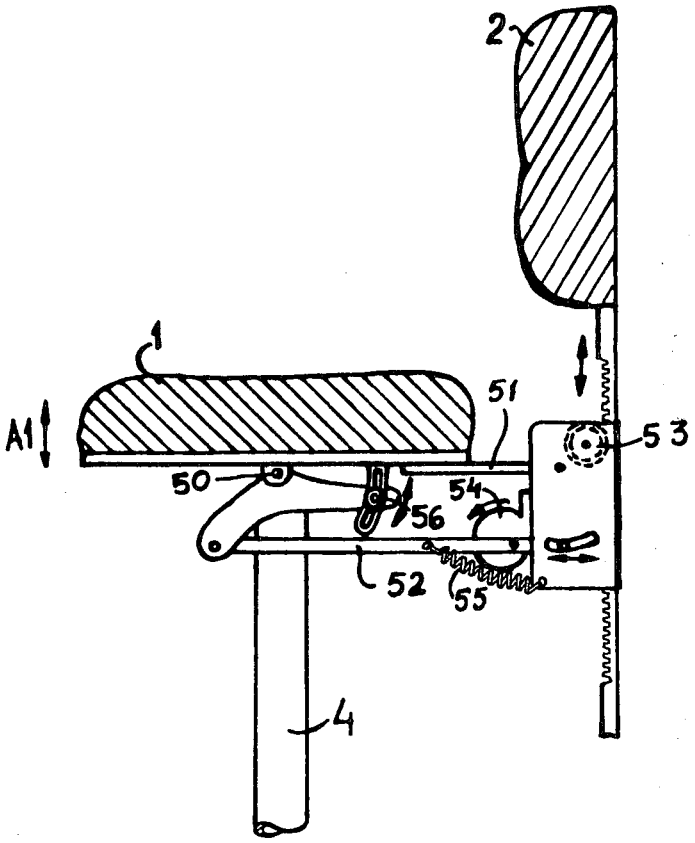

To give a clear and unambigous understanding of the present invention it is below given a detailed description of the chair according to said invention, and it is also referred to the accompanying drawings, in which:

FIG. 1 shows a perspective view of a chair according to the present invention, FIG. 2 shows an arm rest fastened by two supports to the chair body, FIG. 3 shows an exploded view of a universal joint for fastening an arm rest to a support, or for fastening a support to the chair body, FIG. 4 illustrates, partly in cross section, a further embodiment of a multiple layer universal joint, and FIG. 5 is a simplified representation illustrating the principle of the seat tilting mechanism.

In FIG. 1 there is shown a preferred embodiment of a chair according to the present invention. In this FIG. 1 represents the seat, 2 the back of the chair, 3 the arm rests, 4 the bearing column, and 5 the circular base plate. Each arm rest 3 is fastened to a supporting member 6, which again is fastened to the body of the chair, preferably just below the seat as shown. The chair is standing on six rollers 7, of which only four are shown on the figure.

As illustrated by the arrows A, B, C on the figure, each of the arm rests may be tilted in any direction desired. And the arm rests may also be raised/lowered as indicated by arrows D, and finally the arrows E, F illustrate that the arm rest supports may be rotated/-tilted in all directions. The large freedom of movement of said arm rests is rather simply attained by using one universal joint 8 at the top of each supporting member 6, and a similar, but somewhat modified universal joint 9 at the connecting point between the supporting member 6 and the chair body 10.

This preferred chair embodiment comprises many features which partly are earlier known from existing chairs. Thus the bearing column 4 is telescopic to admit raising/lowering of the seat 1. The bearing rollers 7 are swivel mounted to allow smooth positioning on the floor in all directions. The rollers may of course be replaced by per se known slideknobs or even a sliding ring for use on carpets. The base plate 5 has a better function, and differs from earlier known solutions. Thus it forms a better foot rest than the usual four or five extending legs.

Another new feature is the seat support. The seat is tiltable in a forward/backward manner. And the back rest is fastened to the seat in such a manner that it moves up/down as the seat tilts forwards/backwards, respectively. This is obtained by fastening the back rest 2 to the seat portion 1 via a parallel beam arrangement. The tilting of the seat therefore does not lead to a tilting of the back rest. This is explained in more detail in connection with FIG. 5.

The levers 11 and 12 are used to lock/unlock the telescopic column 4 and the tilting of the seat, respectively.

The main feature of the chair according to this invention is, however the arm rest adjusting arrangement. From FIG. 1 it is understood that the arm rests may be adjusted sideways, forwards/backwards; up/down and even may be tilted in any desired direction by operating the two levers 8 and 9 for each arm rest.

To give a better understanding of how these adjusting possibilities may be implemented, it is referred to the following figures and to the description below.

In FIG. 2 there is shown that each arm rest may be supported by two supporting members 6. This solution is only required if the joints 8 and 9 are not strong enough to take up the load exerted on the arm rest.

In FIG. 3 there is shown an exploded view of a preferred embodiment of a universal joint used on a chair according to this invention.

In FIG. 3 the supporting member 6 is to be enclosed by the ferrule 20 having a threaded stud 21 welded, or otherwise fastened thereto. On this threaded stud 21 the first spherical shell section 22 may be arranged. The first spherical shell section 22 is equipped with two semicircular recesses 23 adapted to partly embrace the supporting member 6, and has a hole 24 adapted to receive the threaded stud 21.

A second spherical shell 25 having, substantially the same inner diameter as the outer diameter of the first spherical shell 22 is then to be arranged onto the first shell, also receiving the threaded stud 21. The central hole 26 in the second spherical shell 25, has an oversize relative to the stud's dimension. Due to this hole oversize the second shell 25 may be angularly shifted relative to the first shell 22. The oversized hole 26, may have an oversize only in one direction, as shown in the figure, or may be e.g. a circular hole having an actual oversize in all directions. Other shapes of this hole may also be used, and the shape and size of the hole determine the angular limits between which the second shell 25 may be moved.

Above the second spherical shell section 25 a third spherical shell section 27 may be arranged. This third shell section has a hole 28 adapted closely to take up the stud 21. Finally a nut 29 having a handle 30 fastened thereto, e.g. by means of a screw 31, is to be screwed onto the top of the stud 21.

When the joint is completely mounted as described above, the unit may be rotated around the supporting members 6, or may be shifted axially along the member to any desired position. In addition the second shell 25 may be rotated in relation to the first and third shell sections 22 and 27, at least within certain predetermined limitations. When, however, the nut 29 is tightened on the shaft 21, all components of the joint are pressed together, and the frictional forces between all relatively moveable surfaces provide a bar against any movement at all. By tightening the nut 29 thus the movements in all directions are locked.

Depending on where this universal joint is to be used, minor modifications may be introduced. If the joint shall be used between the supporting member 6 and an arm rest 3, then the ferrule 20 shall not at all be moved axially along the member 6. An effective bar against such movements may be obtained by welding or otherwise securing a ring 32 to the member 6 close to its upper end. When now the upper recess of the first shell 22 is arranged just above the ring 32, then the combined joint cannot be moved along the member 6, but still can be rotated around it as long as the nut 29 is not tightened. If now the arm rest 3 is fixed firmly to the second spherical shell section 25, it may be tilted in any desired direction as long as the nut 29 is not tightened, and it may be rotated as well.

When, however, such a joint shall be used to fix the supporting member 6 to the body of the chair, the ring 32 should be omitted, and the body of the chair now has to be welded or otherwise fastened to the second spherical shell 25. Then all the elements illustrated in FIG. 1 may be undertaken when the nut 29 is not tightened.

To protect the threaded portion of the stud 21 from damages due to relative, small movements between the narrowly adapted hole 28 and the threaded stud, the nut 29 may be provided with a slightly protruding ring-shaped portion 33, which fits snugly into the hole 28 and thus prevents the edge of hole 28 to slide against the threads.

The innermost spherical shell section 22 may be mounted on a distancing tube, formed by spacer wall 62 to obtain a larger distance from the member 6. Such a solution will allow a greater tilt of the shell 25 in some directions, as it then will not come in conflict with the member 6. Such a solution is shown in FIG. 4.

Generally, it may now be seen that there are two elements, namely 6 and 3 (or possibly 6 and 9), which shall be relatively movable. One of these elements (6) is fastened to a first set (22 and 27) of spherical shell sections; while the other element (3 or 9) is fastened to a second set (25) of spherical shell sections.

In FIG. 4 there is shown a still further modification of a universal joint. Here both the sets of spherical shell sections comprise more than one shell-shaped elements. And all shell-shaped elements belonging to the same set, are mechanically secured to ensure a common moving of all elements in one set during operation. The more elements in each set of shells, the larger the frictional force obtained by tightening the nut 29 with a certain moment.

In FIG. 4 also, the supporting member 6 is surrounded by a ferrule 20 having a threaded stud 21 secured thereto. The first set of spherical shell sections comprises the three shells 22, 27 and 40, and it is fastened to the member 6 partly via the threaded stud 21 and partly by the contacting faces 23 between the member 6 and the innermost shell section 22. The second set of shells comprises the shells 41 and 42. These spherical shells are mechanically engaged to each other by means of the teeth 43 in the brim 44 of shell 41 and the corresponding peripheral flaps 45 in the shell 42. For illustrating purposes two of the teeth 43 are shown seen from above in FIG. 4. When the shells are mounted on the threaded stud 21 as earlier explained, the corresponding teeth and flaps will come into engaging contact with each other. Axially, relative to the stud axis, the shells 41 and 42 are quite loosely engaged, and they may be more or less pressed together. During rotative motion, the shells 41 and 42 will, however, act as one single body. And by making the peripheral flaps still longer, they may connect more than two such shells as 41 to one common set of shells.

Of course the universal joint according to this invention may have many different designs within the scope of the invention. The shown embodiments are thus examples only. The spherical shell sections may e.g. be arranged on opposite sides of the supporting members. The arrangement shown is, however, preferred as it represents a more compacted solution.

The curvature radii of the shells may be identical for adjacent surfaces. Then a large contact surface will be the result. This, however, requires very small manufacturing tolerances. It may therefore represent a more practical solution to let the outer of two contacting spherical faces have the smaller radius of the two. Then only an annular ring surface will obtain direct contact with the adjacent surface. Due to the elasticity of the materials the contacting surfaces will increase slightly as the compressing force increases.

Still a different solution may be to let only a brim-shaped annular ring have an exactly spherical surface, while the central portions of the shell is depressed to ensure that it shall not obtain contact with the adjacent spherical surface. Such a solution is shown for the outer shell both in FIG. 3 and in FIG. 4.

By proper surface treatment of the mutual friction surfaces, the required pressure to obtain locking of the joint in a predetermined direction, may be determined. The rougher the contacting surfaces, the smaller the required locking pressure. By proper surface treatment the locking sequence of the movements in different directions may be predetermined. If e.g. the contacting surface between the ferrule 20 and the member 6 is roughened, a lower pressure will lock the ferrule to the member.

In FIG. 5 the arrangement of the seat tilting mechanism is shown in principle. The seat 1 is pivotally hinged to a horizontal axis 50 on the body of the chair. The bearing column 4 supports the body 10 of the chair, and two substantially parallel sets of arms 51 and 52 connect the seat to the back rest arrangement. The upper set of arms 51 is fastened below the seat and therefore tilts with the seat.

When now the seat is tilted forward as indicated by arrow A1, the back rest arrangement is lifted, but substantially without tilting, due to the effect of the parallel arms 51, 52.

As also shown on this figure the back rest 2 may be lowered/raised by an indented bar arrangement 53 also known as rack and pinion and may also be adjusted backward/forward by an eccentric adjuster 54, working against a spring 55.

The desired tilting may be set by a locking arrangement 56 of a per se known type.

It should be noted that a worker seldom or never maintains exactly the same position for a long period. He will always have a need to adjust his position within narrow limits as he undertakes e.g. small movements of his arms during a mounting process. A completely locked position therefore will often not represent the best solution. By arranging a highly flexible member, e.g. a rubber block, between the joint and the adjustable device such as the arm rests or the seat, the device will automatically adjust itself around the preset position or inclination as the externally load varies. A resilient metal member may represent a still better solution than a rubber device.

Finally it should be mentioned that a shell joint according to the above description is really inexpensive in production. The reason for this is that a solid ball of exactly spherical design is rather expensive, while a spherical shell may be produced in a simple and cheap pressing operation. In particular, a conventional ball joint having a large, solid ball and therefore good locking properties, is rather expensive. A spherical shell section joint according to this invention is on the contrary inexpensive even if large dimensions are desirable to withstand large external forces.

The universal joint according to this invention may also be used in all other types of equipment where a universal joint is desired, as e.g. tripods and adjustable devices of any kind.

We claim:

1. A chair having a body and at least one arm rest secured to the chair body, structure for supporting said arm rest and for rendering said arm rest adjustable in all directions, the improvement comprising a first universal joint affixed to the arm rest to render said arm rest rotatable about and tiltable relative to a pivot axis of said joint, an axially elongate support member mating with said joint to support the arm rest and to render the arm rest rotatable about the axis of said support member, a second universal joint affixed to the body of the chair and mating with said support member, the support member being axially advanceable and retractable in said second joint to raise and lower the arm rest accordingly, and means in said second joint allowing lever and rotational movement of said support member in said second joint to render said arm rest movable in a plurality of other motions.

2. A chair as claimed in claim 1 in which there is a second arm rest identical to said first-mentioned arm rest, structure for said arm rest identical to that of first arm rest for rendering the second arm rest movable in all directions independently of the first arm rest.

3. A chair as claimed in claim 1, in which each said universal joint includes a locking lever mounted on the pivot axis of the joint and in which there are a plurality of essentially hemispherical shells mounted on the pivot axis of each joint, said shells positioned adjacent one another with a frictionally engaging relationship between surfaces of said shells.

4. A chair as claimed in claim 2 in which there is a threaded stud disposed on the axis of each of said joints to hold the shells together under the control of the respective locking lever.

5. A chair as claimed in claim 3 in which said stud has a ferrule at the end thereof opposite the lever for receiving said support member, said member comprising a tubular support.

6. A chair structure having adjustable arm rests at the sides thereof, means for adjustably mounting each arm rest to the body of the chair comprising a first universal joint affixed to the respective arm rest and a second universal joint affixed to the chair body, a tubular support member extending between and mating with both said universal joints to support and space said arm rest from the chair body, the mating of the first universal joint to the arm rest enabling rotation and movement of the arm rest relative to the axis of the first joint, the mating of the support member with the second universal joint enabling movement of the arm rest axial to the support member and rotation and tilt movement of the support member relative to the chair body.

7. A chair structure as claimed in claim 6 in which each universal joint comprises an axial threaded stud with a plurality of hemispherical shells mounted on said stud, stud receiving openings of diverse shape on said shells to enable movement of said shells relative to one another.

8. A chair structure as claimed in claim 7, in which there is a locking release lever pivotal about the axis of the stud for changing the relationship between the shells.

* * * * *